US009225097B2

(12) United States Patent
Yokoo

(10) Patent No.: US 9,225,097 B2
(45) Date of Patent: Dec. 29, 2015

(54) ELECTRICAL CONNECTOR HAVING A GUARD PORTION

(71) Applicant: Japan Aviation Electronics Industry, Limited, Tokyo (JP)

(72) Inventor: Hiroyuki Yokoo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/291,564

(22) Filed: May 30, 2014

(65) Prior Publication Data

US 2015/0024617 A1 Jan. 22, 2015

(30) Foreign Application Priority Data

Jul. 17, 2013 (JP) ..... 2013-148873

(51) Int. Cl.

| | |
|---|---|
| ***H01R 3/00*** | (2006.01) |
| ***H01R 13/447*** | (2006.01) |
| ***H01R 13/62*** | (2006.01) |
| ***H01R 12/88*** | (2011.01) |
| ***H01R 13/52*** | (2006.01) |

(52) U.S. Cl.

CPC ..... *H01R 13/447* (2013.01); *H01R 12/88* (2013.01); *H01R 13/5213* (2013.01); *H01R 13/62* (2013.01)

(58) Field of Classification Search

CPC ... H01R 12/79; H01R 23/684; H01R 13/5213
USPC ..... 439/495, 260, 261, 142
See application file for complete search history.

(56) References Cited

U.S. PATENT DOCUMENTS

| | | | |
|---|---|---|---|
| 8,651,885 B2 | 2/2014 | Ashibu | |
| 8,662,916 B2 * | 3/2014 | Ashibu | 439/495 |

(Continued)

FOREIGN PATENT DOCUMENTS

| | | |
|---|---|---|
| JP | H10-189180 A | 7/1998 |
| JP | 2004-193045 A | 7/2004 |
| JP | 2005-243390 A | 9/2005 |

(Continued)

OTHER PUBLICATIONS

Korean Office Action in Application No. 10-2014-0066703 dated Sep. 7, 2015 with English translation.

*Primary Examiner* — Abdullah Riyami
*Assistant Examiner* — Thang Nguyen
(74) *Attorney, Agent, or Firm* — Collard & Roe, P.C.

(57) ABSTRACT

A connector is connectable with a sheet-like or plate-like object having an end. The connector comprises a base member, a contact and an actuator. The contact is held by the base member. The actuator is supported by the base member so as to be openable and closable. The actuator is selectively locatable at a contact guard position, an open position and a keep position. When the actuator is closed to the contact guard position under a state where the object is not mounted on the mount surface, the guard portion is, at least in part, located under the mount surface in the up-down direction while the guard portion hides the contact point so that the contact point is unable to be seen when the connector is viewed from the front thereof in the front-rear direction.

13 Claims, 10 Drawing Sheets

(56) References Cited

U.S. PATENT DOCUMENTS

| | | | | |
|---|---|---|---|---|
| 2012/0258618 | A1* | 10/2012 | Sasaki et al. | 439/260 |
| 2013/0023138 | A1* | 1/2013 | Sasaki et al. | 439/260 |
| 2013/0231002 | A1* | 9/2013 | Yokoo | 439/372 |
| 2013/0244464 | A1* | 9/2013 | Hsieh | 439/261 |
| 2013/0273760 | A1* | 10/2013 | Narita | 439/153 |
| 2013/0309887 | A1* | 11/2013 | Honda | 439/260 |
| 2014/0057478 | A1* | 2/2014 | Yoshisuji et al. | 439/350 |

FOREIGN PATENT DOCUMENTS

| | | | |
|---|---|---|---|
| JP | 2006-073319 | A | 3/2006 |
| JP | 2007-095650 | A | 4/2007 |
| JP | 2013-038004 | A | 2/2013 |
| JP | 2013-038007 | A | 2/2013 |
| KR | 2012-0028355 | A | 3/2012 |

* cited by examiner

ELECTRICAL CONNECTOR HAVING A GUARD PORTION

CROSS REFERENCE TO RELATED APPLICATIONS

The applicant claims priority under 35 U.S.C. §119 of Japanese Patent Application No. JP2013-148873 filed Jul. 17, 2013.

BACKGROUND OF THE INVENTION

This invention relates to a connector configured to be connected to a plate-like or sheet-like object such as a Flexible Printed Circuit (FPC) or a Flexible Flat Cable (FFC).

For example, this type of connector is disclosed in JP-A 2004-193045 (Patent Document 1), contents of which are incorporated herein by reference.

As shown in FIG. 19, the connector of Patent Document 1 comprises an insulating housing, a plurality of contacts and an actuator. The plurality of contacts are held by the insulating housing. The actuator is supported by the insulating housing so that the actuator can be selectively under an open state (FIG. 19(A)) and a close state (FIG. 19(B)). When the actuator is turned forward to be closed under a state where an end of an FPC is inserted into the connect, the end of the FPC is pressed on contact points of the contacts.

A problem of dust deposition to the contact points of the contact often occurs in the connector of Patent Document 1.

SUMMARY OF THE INVENTION

It is therefore an object of the present invention to provide a connector which connects to an object such as an FPC etc. and has an excellent dust proof structure.

The inventor of the present invention has found that the connector of Patent Document 1 has an opening at the front end of the connector, as shown in FIG. 19 (B), when an object such as an FPC is not inserted into the connector even if the actuator is under the close state. The inventor of the present invention has considered that it is effective to minimize the opening to improve a dust proof effect. More specifically, the present invention provides a connector described below.

One aspect of the present invention provides a connector being connectable with a sheet-like or plate-like object having an end. The connector comprises a base member, a contact and an actuator. The base member is formed with a mount surface and a ditch. The ditch is recessed downward from the mount surface in an up-down direction and extends along a front-rear direction perpendicular to the up-down direction. The contact is held by the base member. The contact has a lower portion and a contact point. The ditch accommodates, at least in part, the lower portion. The lower portion is provided with the contact point. The actuator is supported by the base member so as to be openable and closable. The actuator has a press portion and a guard portion and is selectively locatable at a contact guard position, an open position and a keep position located between the open position and the contact guard position. When the actuator is located at the open position, the guard portion is located upward of the press portion in the up-down direction so that the end of the object is mountable on the mount surface. The guard portion is located forward of the press portion in the front-rear direction when the actuator is located at the keep position or the contact guard position. When the actuator is closed to the keep position under a state where the end of the object is mounted on the mount surface, the press portion presses the end of the object against the mount surface while the contact point of the contact is brought into contact with the end of the object. When the actuator is closed to the contact guard position under a state where the object is not mounted on the mount surface, the guard portion is, at least in part, located under the mount surface in the up-down direction while the guard portion hides the contact point so that the contact point is unable to be seen when the connector is viewed from the front thereof in the front-rear direction.

The connector of one aspect of the present invention has a structure which enables the actuator to be closable to the contact guard position under a state where the object such as an FPC is not mounted on the mount surface. When the actuator is closed to the contact guard position, the guard portion is, at least in part, located under the mount surface while the guard portion hides the contact point so that the contact point is unable to see when the connector is viewed from the front thereof. As a result, even if the object such as an FPC is not mounted on the mount surface, the actuator located at the contact guard position can prevent dust from entering from the outside of the connector to reach the contact point.

An appreciation of the objectives of the present invention and a more complete understanding of its structure may be had by studying the following description of the preferred embodiment and by referring to the accompanying drawings.

Figure 1:
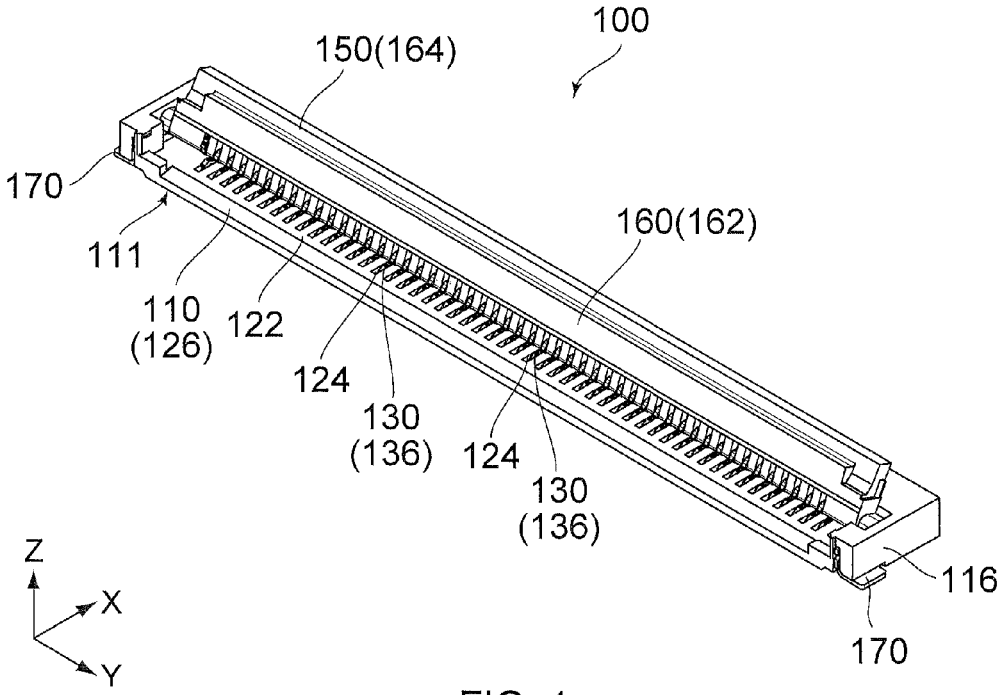
FIG. 1 is a front, perspective view showing a connector according to an embodiment of the present invention. An actuator is located at an open position.
Figure 2:
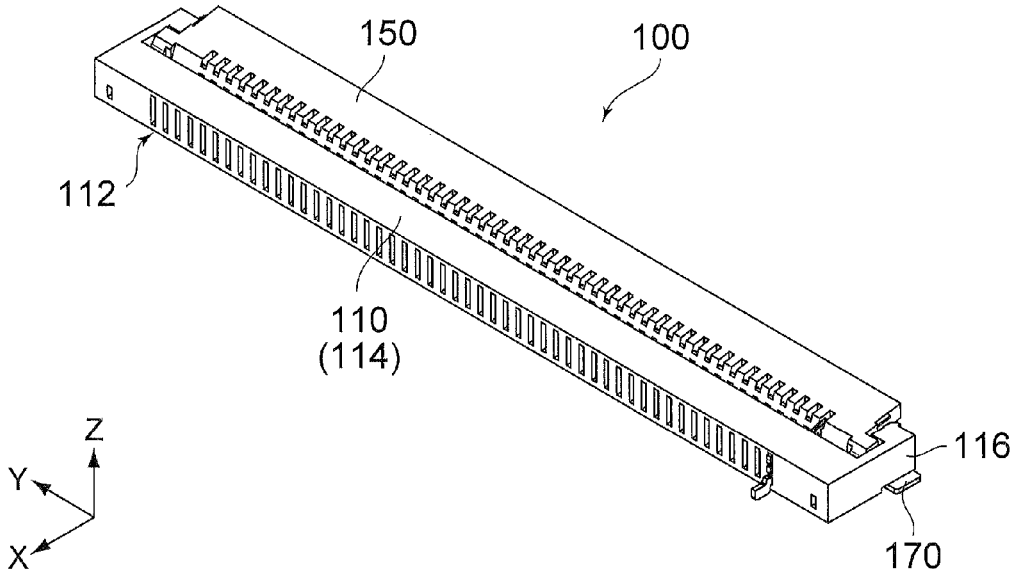
FIG. 2 is a rear, perspective view showing the connector of FIG. 1. The actuator is turned over but not reach a contact guard position. Almost all contacts are omitted.
Figure 3:
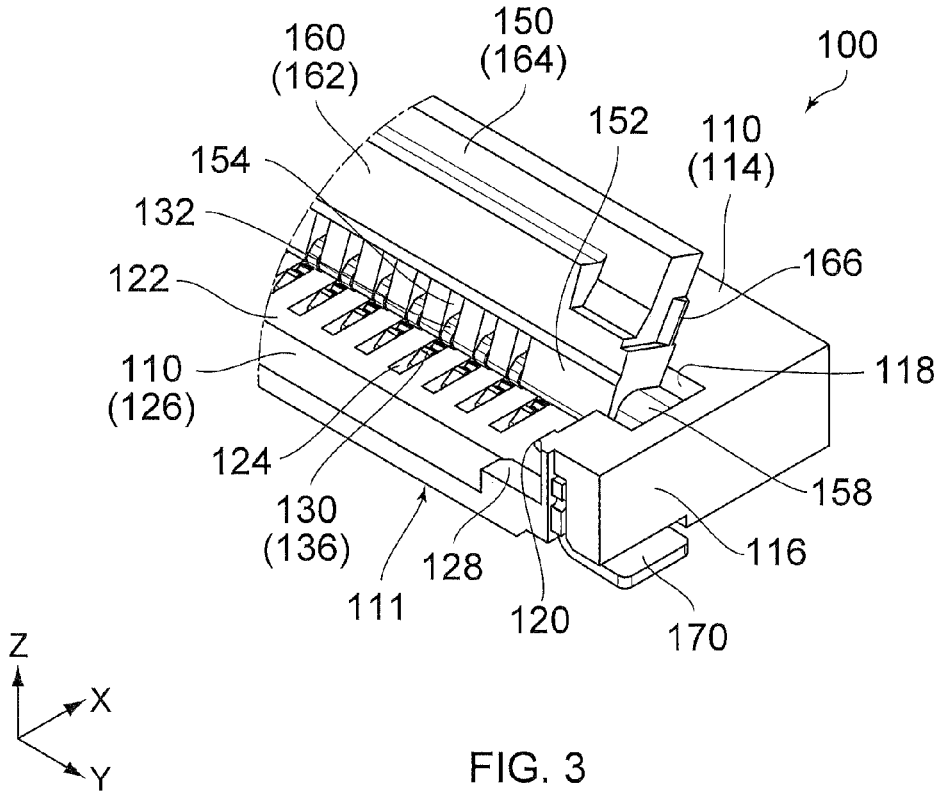
FIG. 3 is an enlarged view showing a part of the connector of FIG. 1.
Figure 4:
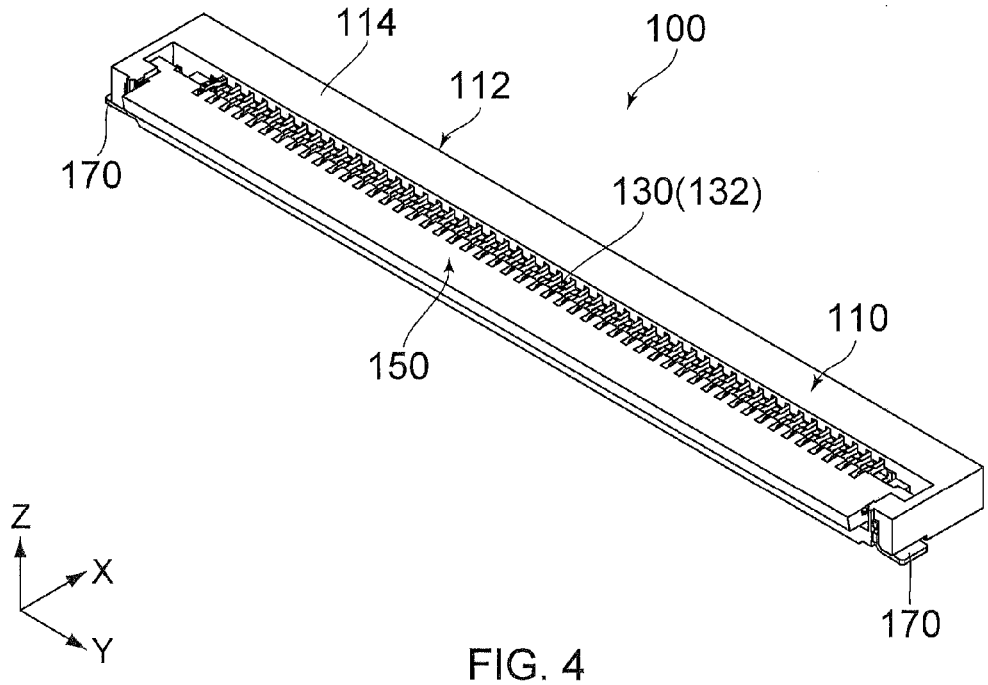
FIG. 4 is another front, perspective view showing the connector of FIG. 1. The actuator is located at the contact guard position.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 17:
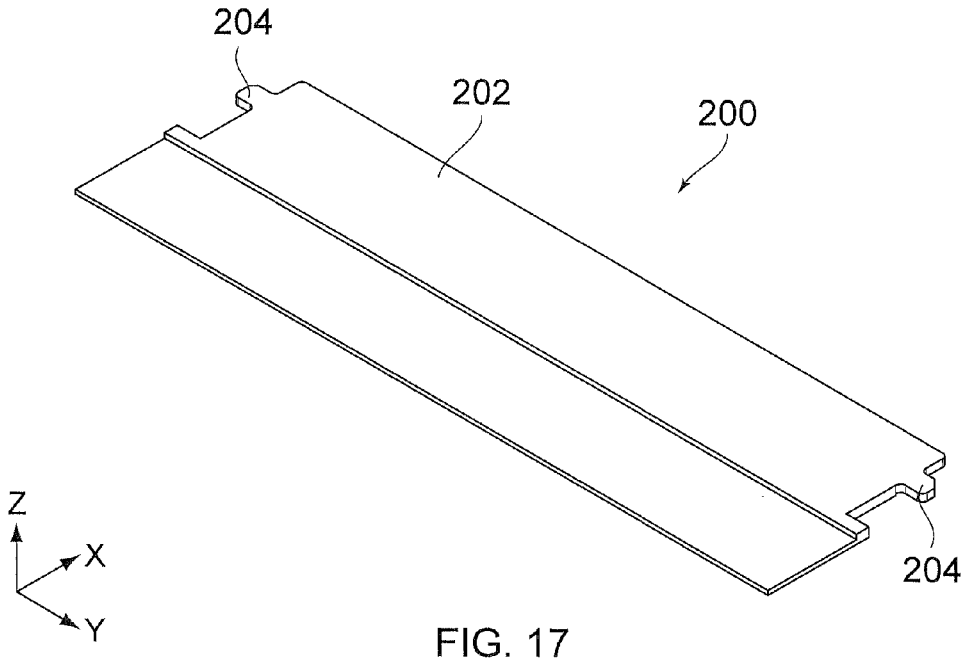
FIG. 17 is a perspective view showing an FPC which is connectable to the connector of FIG. 1.

Referring to FIGS. 1 to 7, a connector 100 of the present invention is mounted on a circuit board (not shown) and is connected with an FPC 200 as a connectable object. The connector 100 comprises a base member 110, a plurality of contacts 130, an actuator 150 and hold downs 170. The base member 110 is made of an insulator. Each of contacts 130 is made of a conductor. The actuator 150 is made of an insulator. Each of the hold downs 170 is made of a metal. As shown in FIG. 17, the FPC 200 has an end portion 202 provided with terminals (not shown) and tabs 204. The tabs 204 project outward from opposite ends of the end portion 202 in a Y-direction (pitch direction: lateral direction), respectively. In addition, a connectable object to the connector 100 of the present invention is not limited to the FPC 200 and may be an FFC, another sheet-like or plate-like object.

Figure 8:
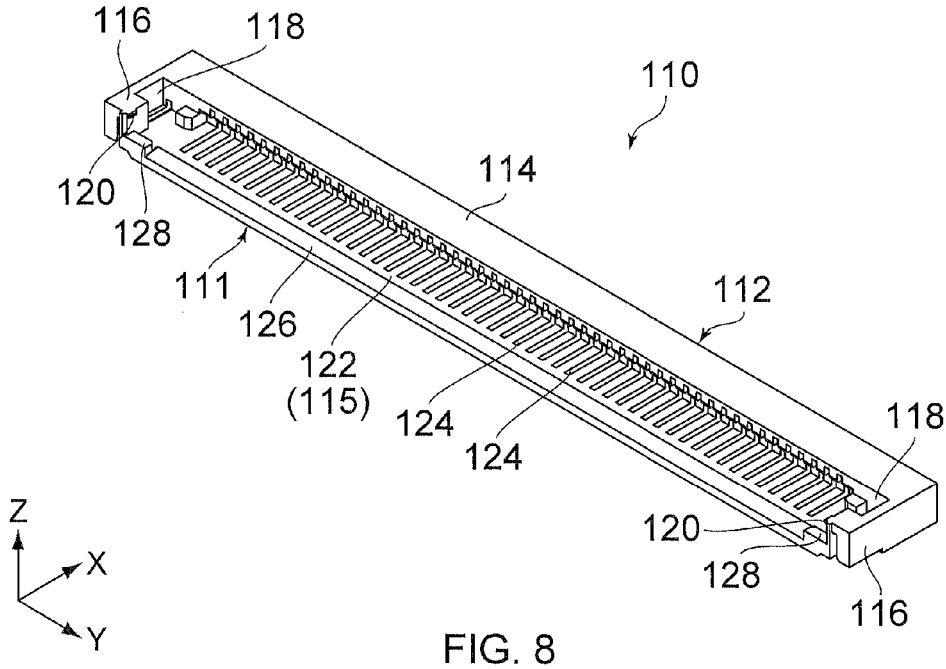
FIG. 8 is a perspective view showing a base member included in the connector of FIG. 1.
Figure 9:
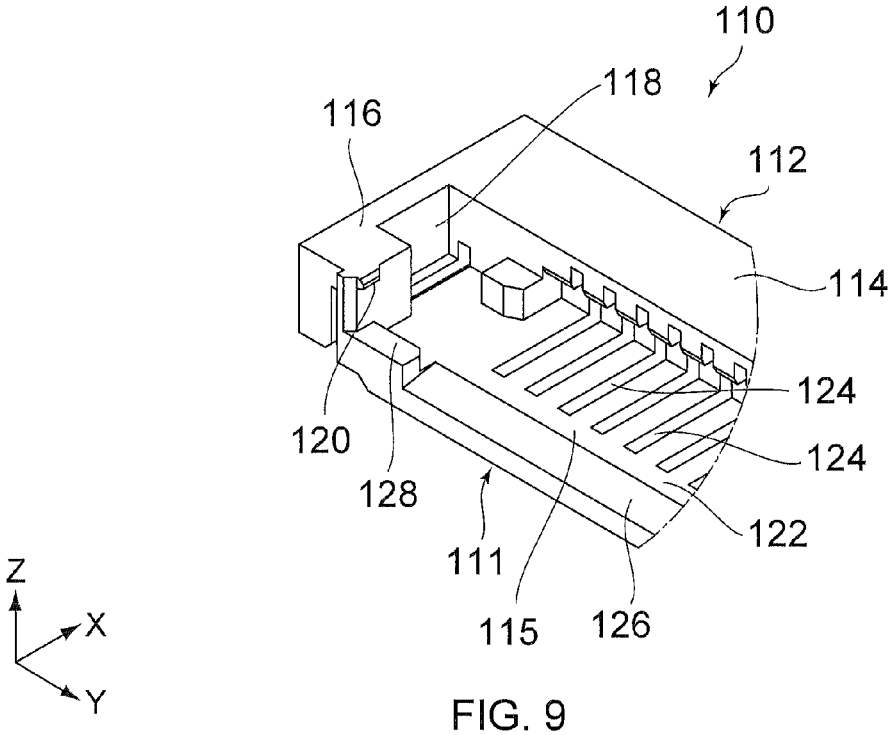
FIG. 9 is an enlarged view showing a part of the base member of FIG. 8.

As shown in FIGS. 8 and 9, the base member 110 has a hold portion 114, a plate-like portion 115 and side walls 116. The hold portion 114 has an elongated, block-like shape extending long in the Y-direction. The plate-like portion 115 extends from the hold portion 114 toward a negative X-side, or forward, in an X-direction (front-rear direction). The side walls 116 are located at opposite ends of the plate-like portion 115 in the Y-direction, respectively.

Figure 13:
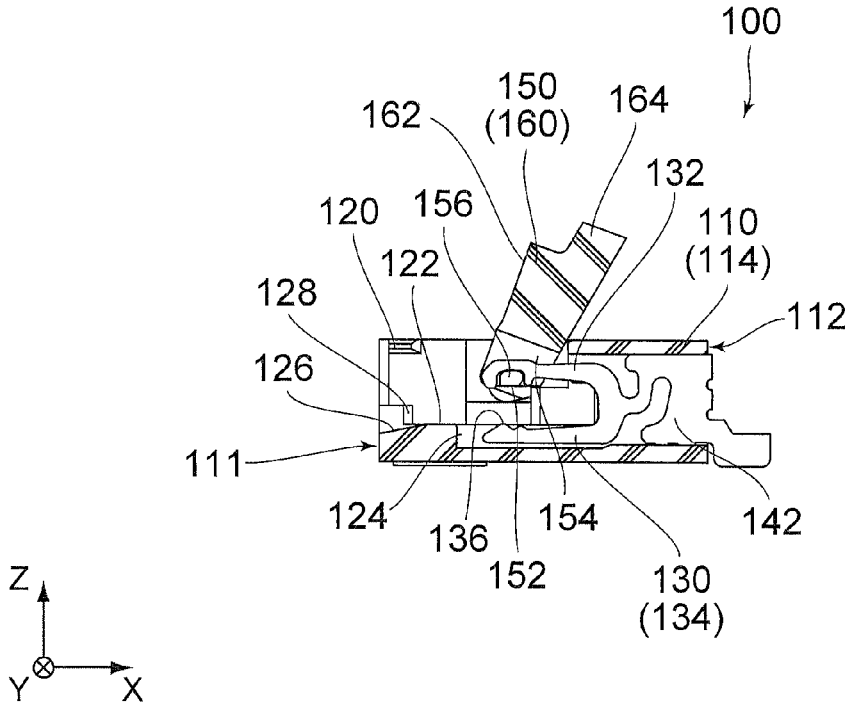
FIG. 13 is a cross-sectional view showing the connector of FIG. 1. The actuator is located at the open position.
Figure 14:
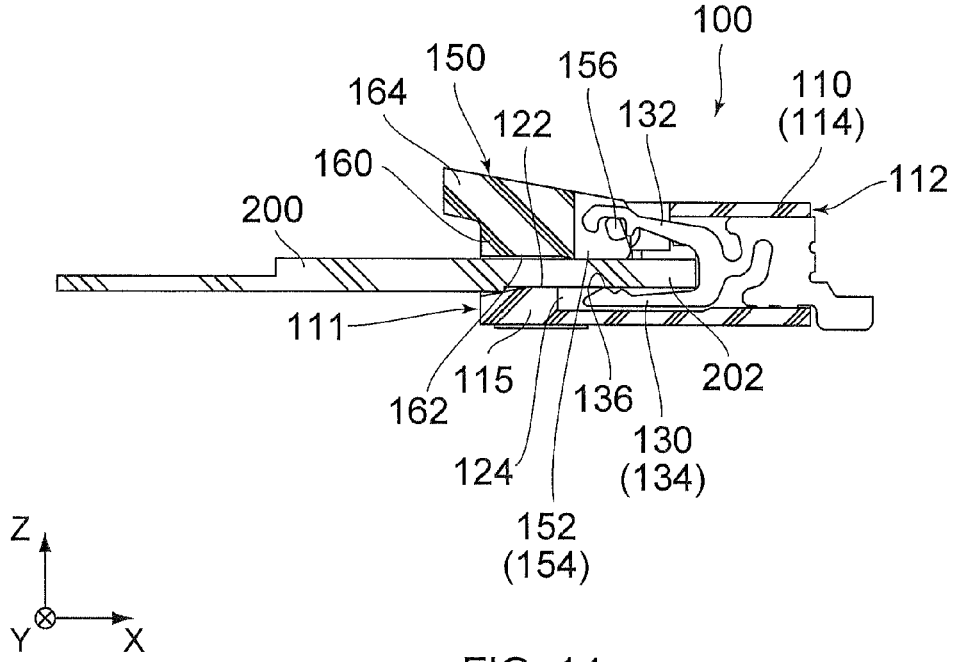
FIG. 14 is another cross-sectional view showing the connector of FIG. 1. The actuator is located at the keep position.
Figure 15:
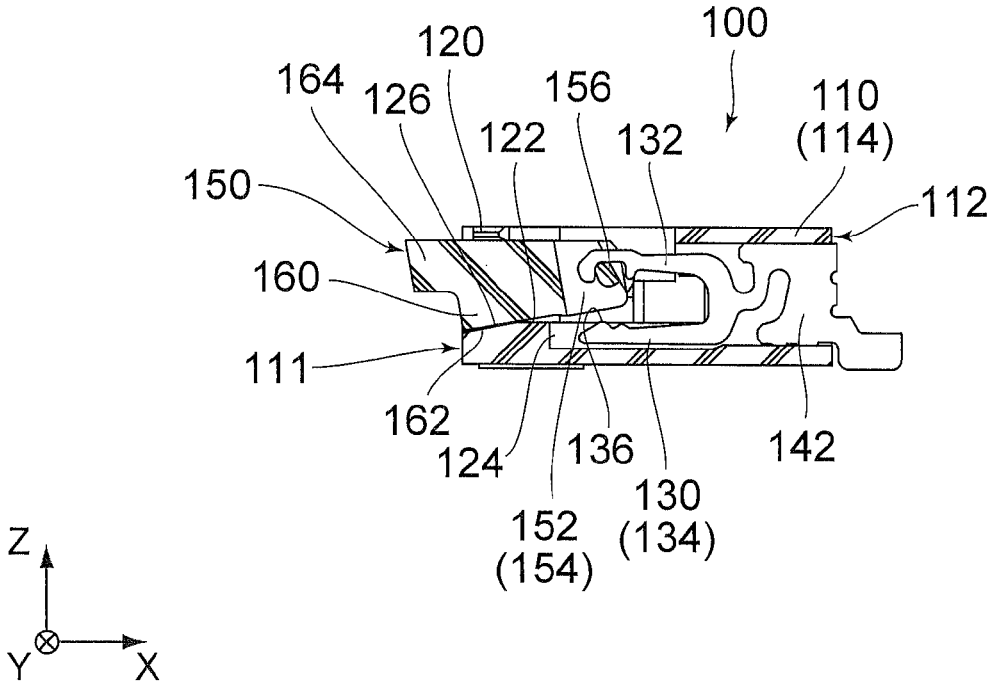
FIG. 15 is yet another cross-sectional view showing the connector of FIG. 1. The actuator is located at the contact guard position.

As shown in FIG. 8, the hold portion 114 forms a back end 112 of the base member 110. As shown in FIGS. 13 to 15, the hold portion 114 holds the contacts 130.

As shown in FIGS. 8 and 9, a size (thickness) of the plate-like portion 115 in a Z-direction (up-down direction) is smaller than the hold portion 114 and the side walls 116. Specifically, the plate-like portion 115 is thinner than the hold portion 114 and the side walls 116.

As shown in FIG. 14, a positive Z-side surface, or an upper surface, of the plate-like portion 115 serves as a mount surface 122 on which the FPC 200 is to be mounted. As shown in FIGS. 8 and 9, a plurality of ditches 124 are formed with the plate-like portion 115. Each of the ditches 124 is recessed from the mount surface 122 toward a negative Z-side, or downward, and extends along the X-direction (front-rear direction). However, for example, as shown in FIGS. 13 to 15, each of the ditches 124 does not reach a front end 111 of the base member 110. Each of the ditches 124 communicates with the hold portion 114. As described later, the ditches 124 partially accommodate the contacts 130, respectively.

As shown in FIGS. 8 and 9, the plate-like portion 115 is further formed with an oblique surface 126 and block-like stopper portions 128. The oblique surface 126 is located at the negative X-side, or forward, of the mount surface 122. The oblique surface 126 is oblique to both the X-direction and the Z-direction and extends to the front end 111 of the base member 110. The stopper portions 128 are located at the negative X-side, or forward, of the mount surface 122 and located at opposite sides of the oblique surface 126 in the Y-direction, respectively. The stopper portions 128 project in the positive Z-direction. When the FPC 200 is mounted on the mount surface 122, the stopper portions 128 are located at the negative X-side, or forward, of the respective tabs 204 (see FIG. 17) of the FPC 200 to prevent the FPC 200 from coming off the connector 100.

As shown in FIGS. 8 and 9, the side walls 116 extend from opposite ends of the hold portion 114 in the Y-direction toward the negative X-side, or forward, respectively. As shown in FIGS. 1 to 7, the side walls 116 hold the hold downs 170, respectively. In other words, the hold downs 170 are held by opposite ends of the base member 110 in the Y-direction, respectively. When the connector 100 is mounted on the circuit board (not shown), the hold downs 170 are fixed to the circuit board by soldering or the like.

As shown in FIGS. 8 and 9, each of the side walls 116 is provided with a pivot receive groove 118 and a locked portion 120. The pivot receive grooves 118 are recessed outward in the Y-direction from an inside surface of the respective side walls 116 in the Y-direction and extend toward the Z-direction. The locked portions 120 are located in the vicinity of the negative X-side end (front end 111) of the respective side walls 116 in the X-direction and located in the vicinity of the positive Z-side end of the respective side walls 116 in the Z-direction. The locked portions 120 further project inward in the Y-direction from the inside surface of the respective side walls 116 in the Y-direction thereof.

Figure 12:
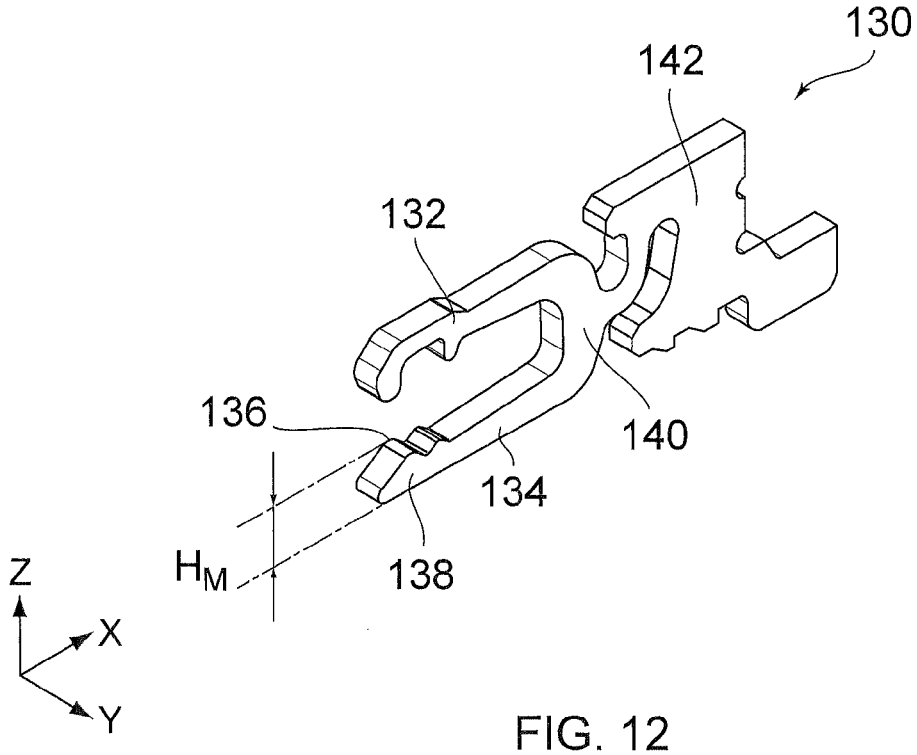
FIG. 12 is a perspective view showing the contact included in the connector of FIG. 1.

As shown in FIG. 12, the contact 130 has an upper portion 132, a lower portion 134, a couple portion 140 and a held portion 142. The lower portion 134 is formed with a contact point 136 connecting to the terminal (not shown) formed at the end portion 202 of the FPC 200. The couple portion 140 couples the upper portion 132 and the lower portion 134 with each other. The upper portion 132 is located away from the lower portion 134 in the Z-direction. The held portion 142 supports the couple portion 140 elastically. Accordingly, for example, when the upper portion 132 is pulled toward the positive Z-side, or upward, the lower portion 134 is also pulled toward the positive Z-side, or upward.

As can be seen from FIGS. 1 and 8, the contacts 130 held by the base member 110 are arranged in the Y-direction. As shown in FIGS. 13 to 15, the held portions 142 are held by the hold portion 114. The lower portions 134 are accommodated in the respective ditches 124. As can be seen from FIGS. 12 to 15, the contact points 136 include respective parts 138 of the lower portions 134 and sizes of the parts 138 in the Z-direction are maximum in respective sizes of the lower portions 134. Each of the parts 138 is hereinafter referred to as "maximum portion". A size of each part 138 in the Z-direction is hereinafter referred to as "$H_M$". The sizes $H_M$ of the parts 138 in the Z-direction are same as or less than the respective sizes of the ditches 124 in the Z-direction (i.e. depth of the ditch 124). In other words, the ditches 124 are larger than the respective maximum portions 138 of the respective lower portions 134 in the Z-direction. Therefore, entire structures of the lower portions 134 can be accommodated in the respective ditches 124

Figure 10:
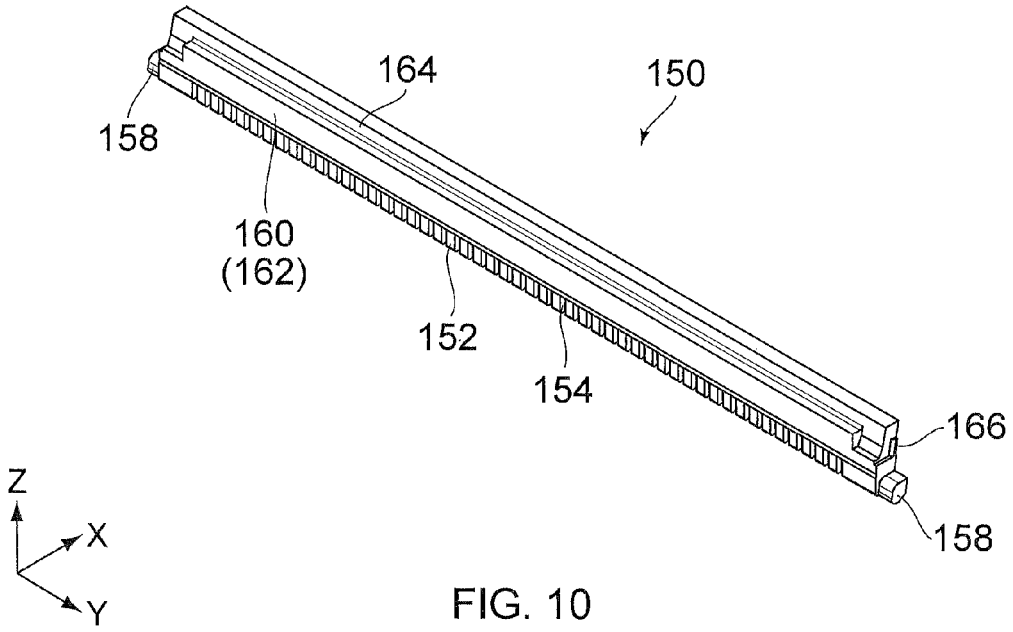
FIG. 10 is a perspective view showing the actuator included in the connector of FIG. 1.
Figure 11:
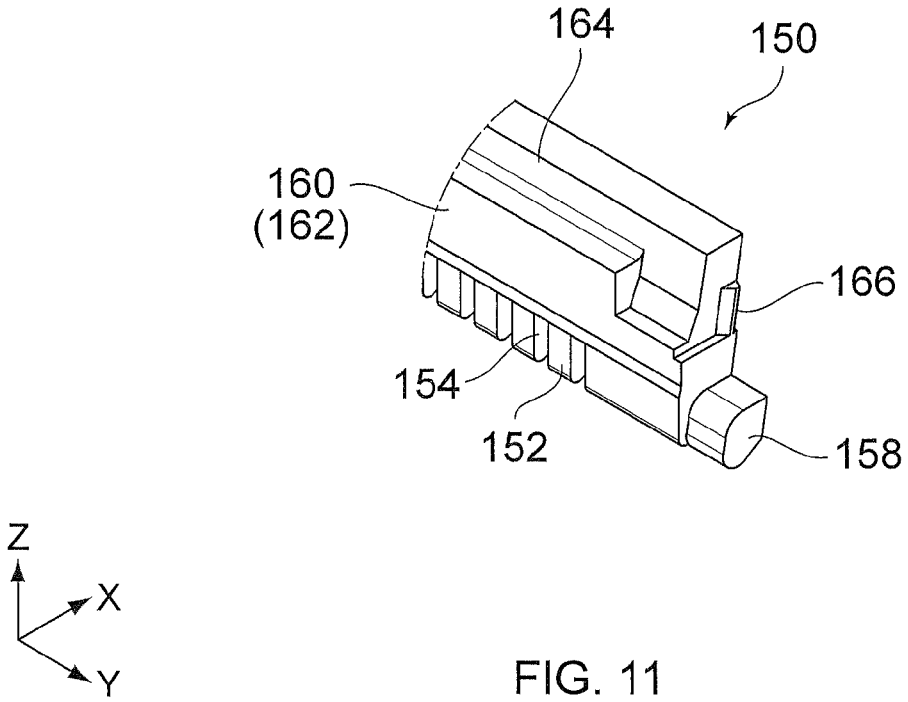
FIG. 11 is an enlarged view showing a part of the actuator of FIG. 10.

As shown in FIGS. 10 and 11, the actuator 150 has a press portion 152, a guard portion 160 and an operation portion 164.

As shown in FIG. 10, pivots 158 are provided at opposite ends of the press portion 152 in the Y-direction, respectively. The pivots 158 project outward. The pivots 158 are received in the respective pivot receive grooves 118 of the base member 110 so that the pivots 158 are turnable and movable in the Z-direction (movable along the up-down direction) within the respective pivot receive grooves 118 (see FIGS. 8 and 9). Accordingly, the actuator 150 is supported by the base member 110 to be openable and closable. In detail, the actuator 150 according to the present embodiment is locatable at an open position (see FIG. 13), a keep position (see FIG. 14) and a contact guard position (see FIG. 15), wherein the keep position is located between the open position and the contact guard position.

As shown in FIGS. 10 and 11, the press portion 152 is formed with a plurality of accommodating portions 154. The accommodating portions 154 have groove shapes and intersect the Y-direction. The accommodating portions 154 correspond to the respective contacts 130. As shown in FIGS. 13 to 15, the accommodating portions 154 receive the respective upper portions 132 of the respective corresponding contacts 130. Each of the accommodating portions 154 is provided in a lift-up portion 156 having a cross section of D-shape. The upper portions 132 of the contacts 130 are located at the positive Z-side, or upward, of the respective lift-up portions 156 in the respective accommodating portions 154. When the actuator 150 is located at the open position (see FIG. 13) and the contact guard position (see FIG. 15), the lift-up portions 156 according to the present embodiment are designed to apply little force to the respective upper portions 132 of the respective contacts 130. When the actuator 150 is located at the keep position (see FIG. 14) under a state where the FPC 200 is mounted on the mount surface 122, the lift-up portions 156 according to the present embodiment are designed to lift up the respective upper portions 132 of the respective contacts 130 (i.e. to move to the positive Z-direction, or upward). In addition, hereinafter, a position at which each of the upper portions 132 is lifted up is referred to as "predetermined position".

As shown in FIG. 13, the guard portion 160 is located at the positive Z-side, or upward, beyond the press portion 152 when the actuator 150 is located at the open position. As shown in FIGS. 14 and 15, the guard portion 160 is located at the negative X-side, or forward, beyond the press portion 152 when the actuator 150 is located at either the keep position or the contact guard position. As shown in FIG. 14, the guard portion 160 has a plane 162 which faces the negative Z-side, or downward, when the actuator 150 is located at the keep position. The plane 162 is located at the positive Z-side, or upward, beyond the lower surface of the press portion 152 when the actuator 150 is located at the keep position. In other word, there is a step difference between the press portion 152 and the guard portion 160. However, the step difference according to the present embodiment is slight and gentle.

As shown in FIGS. 10 and 11, the operation portion 164 is thinner than the guard portion 160 and is located away from the plane 162. Accordingly, there is a relatively large step difference between the operation portion 164 and the guard portion 160. Therefore, it is easy for an operator of the connector 100 to hook his/her fingers with the operation portion 164. As clearly shown in FIGS. 13 to 15, the guard portion 160 is located between the operation portion 164 and the press portion 152.

As shown in FIGS. 10 and 11, the actuator 150 is further formed with lock portions 166. The lock portions 166 are located at opposite ends of the actuator 150 in the Y-direction and project outward in the Y-direction, respectively. When the actuator 150 is located at the keep position (see FIG. 14) or the contact guard position (FIG. 15), the lock portions 166 according to the present embodiment are located in the vicinity of a surface (back surface of the plane 162) which is a positive Z-side surface, or an upper surface, of the actuator 150.

As shown in FIG. 13, when the actuator 150 is located at the open position, the mount surface 122 is visible from the positive Z-side, or upward, and the end portion 202 of the FPC 200 is mountable on the mount surface 122. From a viewpoint of dust proof of the contact points 136, when the actuator 150 is located at the open position, it is preferable that a projecting amount of the contact point 136 of each contact 130 from the mount surface 122 in the Z-direction is one-third of or less than the size $H_M$ (see FIG. 12) of the maximum portion 138 of the lower portion 134 in the Z-direction and it is more preferable that each contact point 136 is located under the mount surface 122 (i.e. the ditch 124 accommodates the lower portion 134 entirely). As can be seen from FIG. 13, in the present embodiment, when the actuator 150 is located at the open position, the contact points 136 are located at almost the same position as the mount surface 122.

As shown in FIG. 14, when the end portion 202 of the FPC 200 is mounted on the mount surface 122 and the actuator 150 is turned to the keep position, the lift-up portions 156 lift up the upper portions 132 of the contacts 130, respectively, to their illustrated predetermined positions. In other words, the lift-up portions 156 move the respective upper portions 132 toward the positive Z-side). Thus, the contact points 136 of the lower portions 134 are also urged to be moved toward the positive Z-side. Accordingly, even if the ditches 124 accommodate entirely the lower portions 134, respectively. While the contact points 136 are located at the negative Z-side, or downward, beyond the mount surface 122 when the actuator 150 is located at the open position, the contact points 136 can contact the end portion 202 of the FPC 200 when the actuator 150 is turned to the keep position. When the actuator 150 is closed to the keep position under a state where the end portion 202 of the FPC 200 is mounted on the mount surface 122, the press portion 152 receives forces directed from the upper portions 132 toward the negative Z-side, or downward, as reaction forces from the upper portions 132 lifted up by the respective lift-up portions 156, and the press portion 152 presses the end portion 202 of the FPC 200 against the mount surface 122. Accordingly, the contact points 136 can be securely brought into contact with terminals (not shown), respectively, of the end portion 202. Meanwhile, as described above, there is a little step difference between the guard portion 160 and the press portion 152 so that the guard portion 160 is located away from the FPC 200 and is not brought into contact with the FPC 200. Therefore, variation of contact reliabilities of the terminals (not shown) of the end portion 202 of the FPC 200 with the respective contact points 136 can be suppressed.

Particularly, in the present embodiment, the upper portions 132 are designed to show stronger resilient forces than the lower portions 134 by adjusting shapes of the contacts 130, respectively. Accordingly, for example, when the upper portions 132 are moved to their predetermined positions under a state where the end portion 202 of the FPC 200 is not mounted on the mount surface 122, the lower portions 134 partially project from the mount surface 122 to the positive Z-side. Additionally, the projecting amounts of the lower portions 134 in the Z-direction are half or more of the respective sizes $H_M$ (see FIG. 12) of the maximum portions 138 in the Z-direction.

Figure 18:
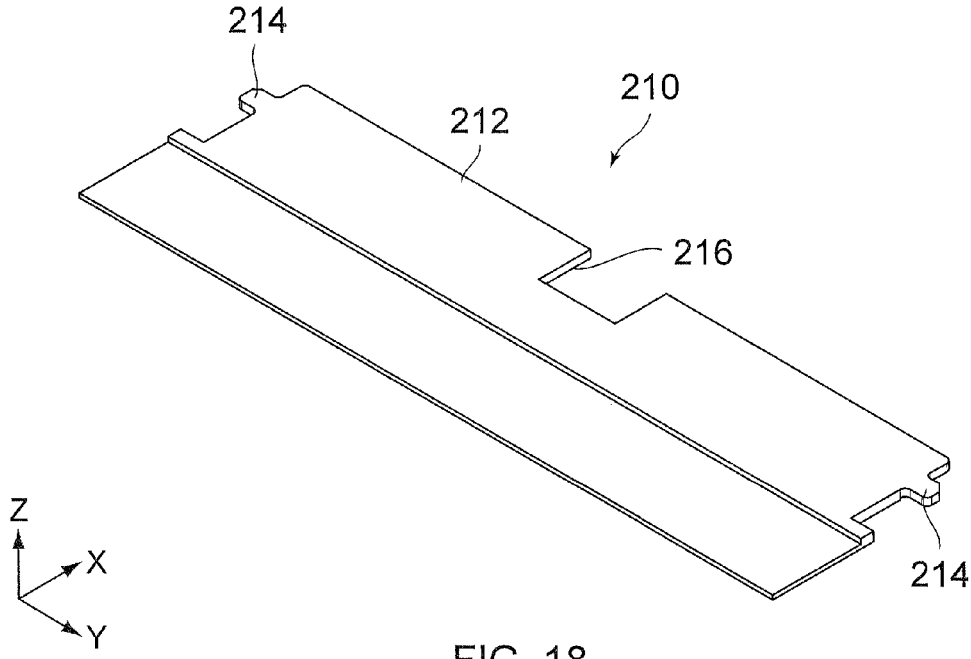
FIG. 18 is a perspective view showing the FPC for verification of the moving distances of the contact points.
Figure 19:
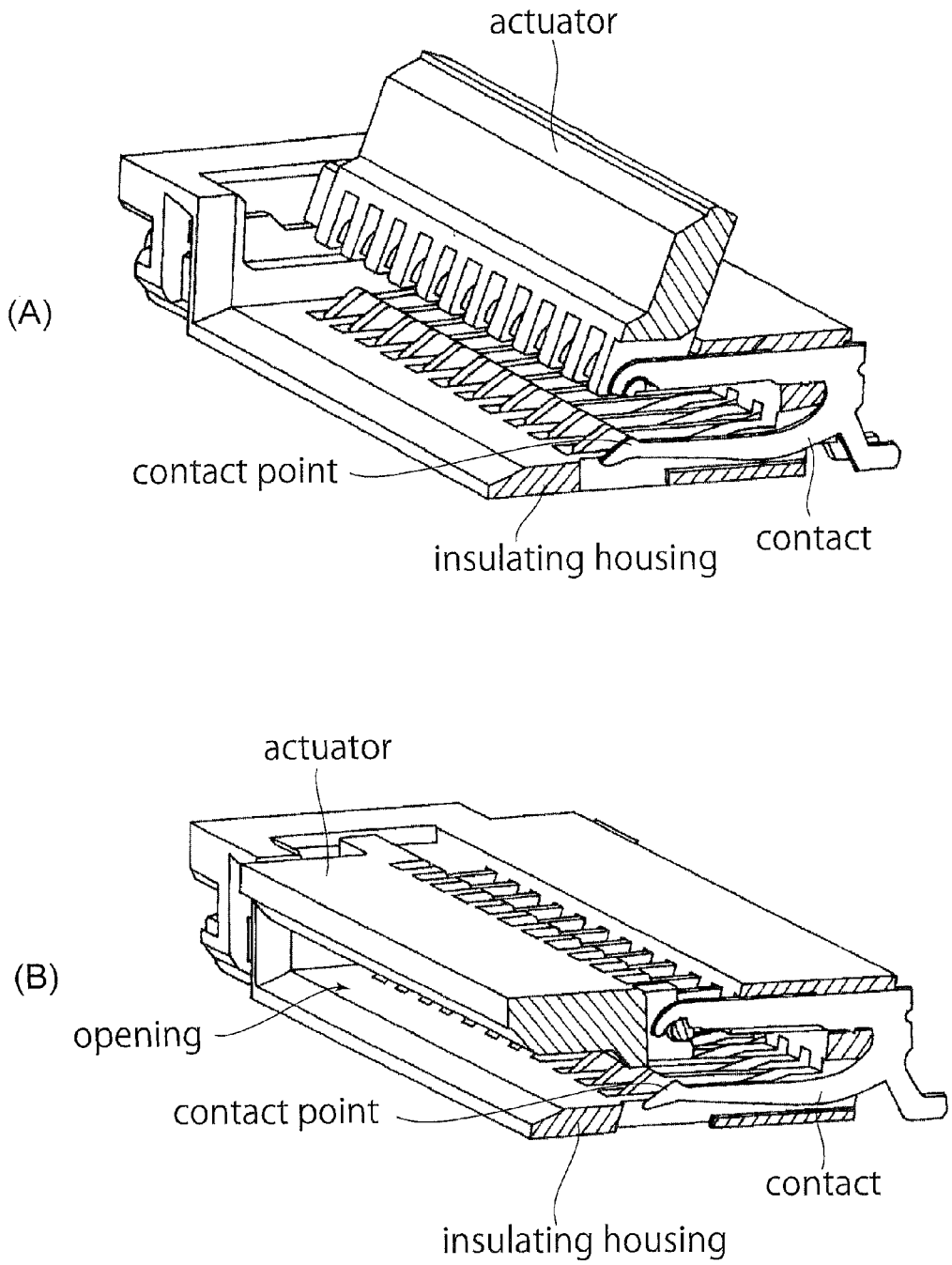
FIG. 19 PRIOR ART
FIG. 19 is a perspective view showing the connector of Patent Document 1. The actuator in FIG. 19(A) is under the open state while the actuator in FIG. 19(B) is under the close state.

For example, it is possible to verify the projecting amounts by using an FPC 210 for verification as shown in FIG. 18. The FPC 210 for verification has an end portion 212 and tabs 214. The tabs 214 are provided at opposite ends of the end portion 212, respectively. The tabs 214 prevent the FPC 210 from coming off the connector 100 as with the usual FPC 200 (see FIG. 17). In addition, the end portion 212 is provided with a recess 216 which has a shape obtained by cutting out a part of the end portion 212.

Figure 16:
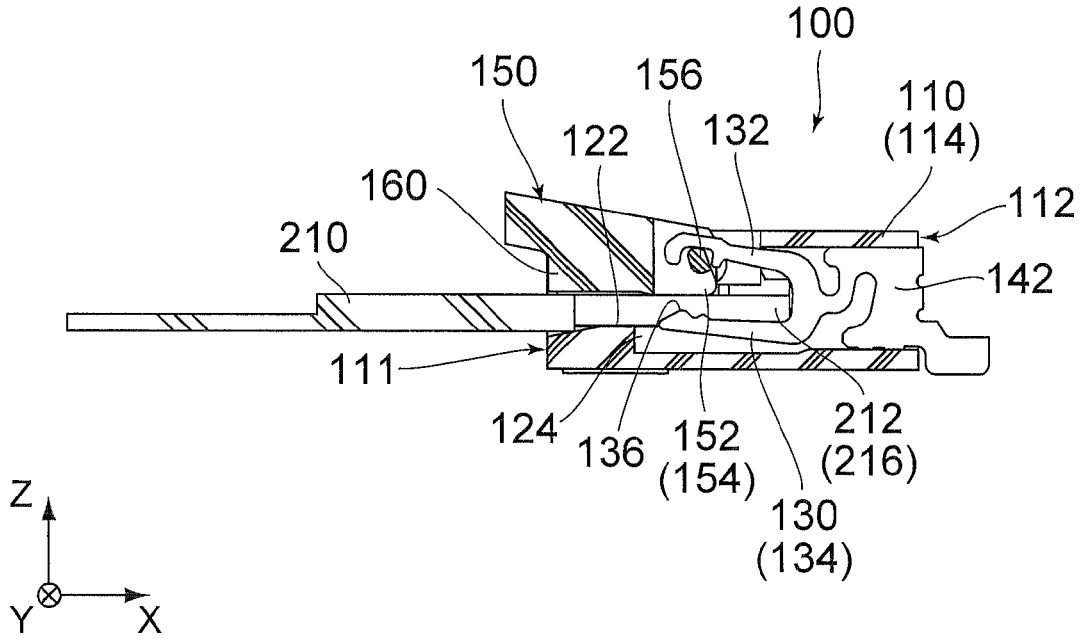
FIG. 16 is still another cross-sectional view showing the connector of FIG. 1. An FPC for verification, as described later, is inserted thereinto, and the actuator is located at the keep position.

When the actuator 150 is turned to the keep position under a state where the FPC 210 for verification is mounted on the mount surface 122, the contacts 130 other than the contacts 130 corresponding to the recess 216 are deformed as shown in FIG. 14 so that the lift-up portions 156 move the respective upper portions 132 to their predetermined positions. At that time, as shown in FIG. 16, the upper portions 132 of the contacts 130 corresponding to the recess 216 are moved to their predetermined positions while the contact points 136 project in the recess 216. When the projecting amounts of the contact points 136 are half or more of their sizes $H_M$ of the maximum portions 138 in the Z-direction, it is verified that the upper portions 132 are able to show sufficiently stronger resilient forces than the lower portions 134. In a case where the resilient forces of the upper portions 132 and the lower portions 134 are designed as described above, the contact points 136 and the press portion 152 put the end portion 202 of the FPC 200 therebetween while the press portion 152 presses the end portion 202 of the FPC 200 against the mount surface 122 by a relatively large force, when the actuator 150 is closed to the keep position under a state where the end portion 202 of the usual FPC 200 is mounted on the mount surface 122, as shown in FIG. 14. At that time, contact positions, where the contact points 136 are brought into contact with the end portion 202 of the FPC 200, are same as a position of the mount surface 122 in the Z-direction.

Figure 5:
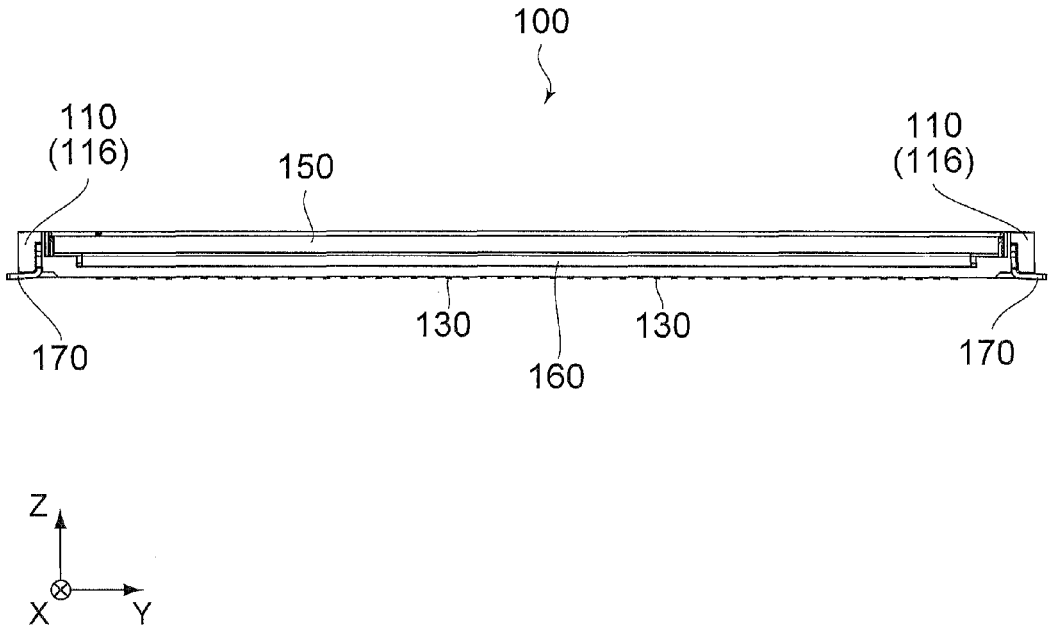
FIG. 5 is a front view showing the connector of FIG. 4.
Figure 6:
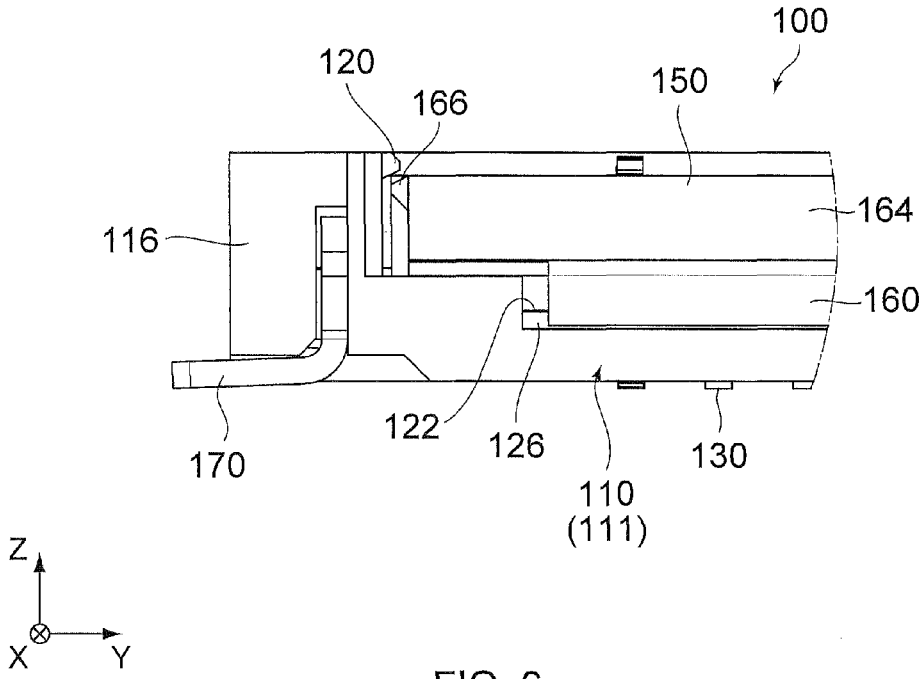
FIG. 6 is an enlarged view showing a part of the connector of FIG. 5.
Figure 7:
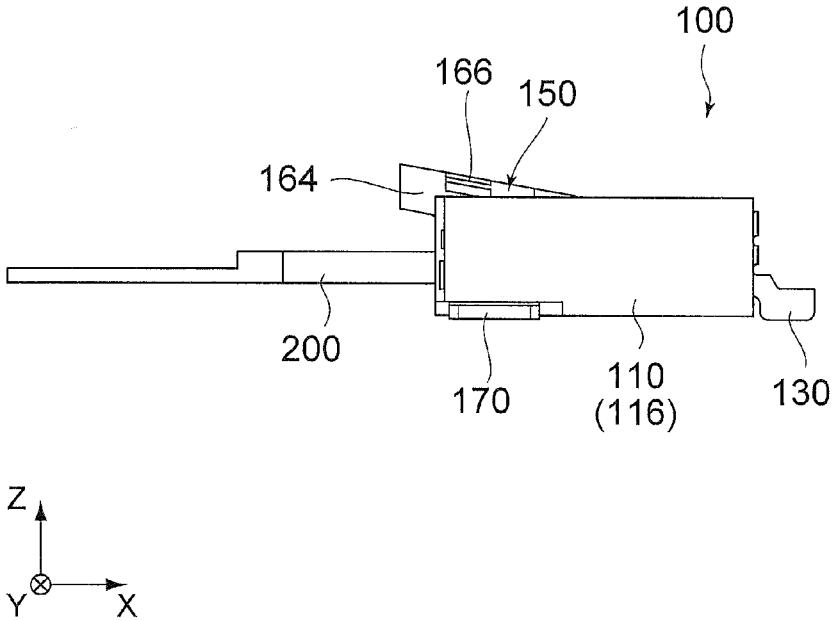
FIG. 7 is a side view showing the connector of FIG. 1. An FPC is partially inserted into the illustrated connector and the actuator is located at a keep position.

As shown in FIG. 15, when the actuator 150 is closed to the contact guard position under a state where the FPC 200 is not mounted on the mount surface 122, the guard portion 160 hides the contact points 136 to protect from dust. In detail, as shown in FIG. 15, when the actuator 150 is located at the contact guard position, the guard portion 160 is partially located at the negative Z-side, or downward, beyond the mount surface 122 in the Z-direction. As shown in FIGS. 5 and 6, when the actuator 150 is located at the contact guard position, the guard portion 160 hides the contact points 136 so that the contact points 136 are unable to be seen when the connector 100 is viewed from the negative X-side, or forward, thereof in the X-direction. Accordingly, the connector 100 according to the present embodiment has a dust proof structure to prevent dust from adhering to the contact points 136. Particularly, as shown in FIG. 15, in the connector 100 according to the present embodiment, when the actuator 150 is located at the contact guard position, the plane 162 of the guard portion 160 faces the oblique surface 126 of the base member 110. In detail, the plane 162 is in surface contact with the oblique surface 126. Accordingly, the connector 100 according to the present embodiment has high dust-proof effect.

As shown in FIG. 6, when the actuator 150 is located at the contact guard position, the lock portions 166 of the actuator 150 are located at the negative Z-side, or downward, of the respective locked portions 120 of the base member 110. Accordingly, the lock portions 166 lock the respective locked portions 120 to prevent the actuator 150 from be moved to the keep position. In other word, when the connector 100 is not connected with anything, the lock portions 166 lock the respective locked portions 120 to prevent the actuator 150 from being freely opened and to prevent dust from adhering to the contact points 136.

While the connector 100 according to the embodiment of the present invention has been described above, the present invention is not limited thereto. Various modifications and applications are possible with the present invention. For example, in above-described embodiment, the guard portion 160 has a plane 162 which faces downward when the actuator 150 is located at the contact guard position. But the guard portion 160 may have a curved planar, or a surface having a step difference, instead of the plane 162. However, to maximize the dust proof effect while minimizing a movable range of the actuator 150, it is preferable that a lower surface of the guard portion 160 is the plane 162. In addition, it is preferable that the base member 110 has the oblique surface 126 opposed to the plane 162.

The present application is based on a Japanese patent application of JP2013-148873 filed before the Japan Patent Office on Jul. 17, 2013, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector being connectable with a sheet-like or plate-like object having an end, the connector comprising: a base member, a contact and an actuator; wherein the base member is formed with a mount surface and a ditch;

the ditch is recessed downward from the mount surface in an up-down direction and extends along a front-rear direction perpendicular to the up-down direction;

the contact is held by the base member;

the contact has a lower portion and a contact point;

the ditch accommodates, at least in part, the lower portion;

the lower portion is provided with the contact point;

the actuator is supported by the base member so as to be openable and closable;

the actuator has a press portion and a guard portion and is selectively locatable at a contact guard position, an open position and a keep position located between the open position and the contact guard position;

when the actuator is located at the open position, the guard portion is located upward of the press portion in the up-down direction so that the end of the object is mountable on the mount surface;

the guard portion is located forward of the press portion in the front-rear direction when the actuator is located at the keep position or the contact guard position;

when the actuator is closed to the keep position under a state where the end of the object is mounted on the mount surface, the press portion presses the end of the object against the mount surface while the contact point of the contact is brought into contact with the end of the object; and when the actuator is closed to the contact guard position under a state where the object is not mounted on the mount surface, the guard portion is, at least in part, located under the mount surface in the up-down direction while the guard portion hides the contact point so that the contact point is unable to be seen when the connector is viewed from the front thereof in the front-rear direction.

2. The connector as recited in claim 1, wherein the guard portion is located away from the object when the press portion presses the end of the object against the mount surface.

3. The connector as recited in claim 2, wherein the guard portion has a plane which faces downward in the up-down direction when the actuator is located at the keep position.

4. The connector as recited in claim 3, wherein:

the base member has an oblique surface which is located forward of the mount surface in the front-rear direction and is oblique to both the up-down direction and the front-rear direction; and the plane of the guard portion faces the oblique surface of the base member when the actuator is located at the contact guard position.

5. The connector as recited in claim 1, wherein:

the contact further has an upper portion, a couple portion and a held portion;

the couple portion couples the lower portion with the upper portion;

the held portion supports the couple portion elastically and is held by the base member;

the actuator further has a receive portion and a lift-up portion;

the receive portion partially receives the upper portion;

the lift-up portion is provided in the receive portion;

the upper portion is located upward of the lift-up portion in the up-down direction; and when the actuator is turned from the open position to the guard position under a state where the end of the object is mounted on the mount surface, the lift-up portion lifts up the upper portion to a predetermined position so that the contact point of the lower portion receives an upward force in the up-down direction.

6. The connector as recited in claim 5, wherein, when the upper portion is moved to the predetermined position under a state where the end of the object is not mounted on the mount surface, the lower portion partially projects from the mount surface, a projecting amount of the lower portion in the up-down direction is half or more of a size of a maximum portion of the lower portion in the up-down direction; and the maximum portion includes the contact point.

7. The connector as recited in claim 1, wherein:

the base member has a front end; and the ditch does not reach the front end of the base member.

8. The connector as recited in claim 1, wherein the ditch is larger than a maximum portion of the lower portion in the up-down direction; and the maximum portion includes the contact point.

9. The connector as recited in claim 8, wherein a projecting amount of the contact point from the mount surface in the up-down direction is one third or less of the size of the maximum portion of the lower portion in the up-down direction when the actuator is located at the open position.

10. The connector as recited in claim 9, wherein the contact point is located under the mount surface in the up-down direction when the actuator is located at the open position.

11. The connector as recited in claim 8, wherein, when the end of the object is mounted on the mount surface and the actuator is located at the guard position, a contact position, where the contact point of the contact is brought into contact with the end of the object, is equal to an position of the mount surface in the up-down direction.

12. The connector as recited in claim 1, wherein:

the base member is provided with a locked portion;

the actuator is provided with a lock portion; and when the object is not mounted on the mount surface and the actuator is located at the contact guard position, the lock portion is locked with the locked portion to prevent the actuator from moving to the keep position.

13. The connector as recited in claim 1, wherein:

the connector comprises a plurality of the contacts;

the base member is formed with a plurality of the ditches; and the plurality of the ditches accommodate the plurality of the contacts, respectively.

* * * * *